US006662743B1

(12) United States Patent
Rolfe

(10) Patent No.: US 6,662,743 B1
(45) Date of Patent: Dec. 16, 2003

(54) FOLDABLE BOATS

(75) Inventor: David Windsor Rolfe, Beaconsfield (GB)

(73) Assignee: Clamboat Limited, Gerrards Cross (GB)

( * ) Notice: Subject to any disclaimer, the term of this patent is extended or adjusted under 35 U.S.C. 154(b) by 0 days.

(21) Appl. No.: 10/110,151

(22) PCT Filed: Oct. 9, 2000

(86) PCT No.: PCT/GB00/03878

§ 371 (c)(1),
(2), (4) Date: Apr. 5, 2002

(87) PCT Pub. No.: WO01/25079

PCT Pub. Date: Apr. 12, 2001

(30) Foreign Application Priority Data

Oct. 7, 1999 (GB) ..... 9923607

(51) Int. Cl.[7] ..... B63B 21/64
(52) U.S. Cl. ..... 114/344; 114/353
(58) Field of Search ..... 114/344, 352, 114/353

(56) References Cited

U.S. PATENT DOCUMENTS

| | | | | | |
|---|---|---|---|---|---|
| 1,658,500 A | * | 2/1928 | Tewes | 114/353 |
| 2,781,529 A | * | 2/1957 | Moody | 114/344 |
| 3,061,845 A | * | 11/1962 | Gerbracht | 114/344 |
| 3,090,973 A | | 5/1963 | Levinson | 9/1 |
| 3,289,225 A | * | 12/1966 | Isch et al. | 114/344 |
| 4,180,881 A | | 1/1980 | Speranza | 9/2 F |
| 4,522,143 A | | 6/1985 | Holzbaur | 114/344 |
| 5,868,097 A | | 2/1999 | Spickelmire | 114/353 |

FOREIGN PATENT DOCUMENTS

| | | | |
|---|---|---|---|
| EP | 0 392 436 A | 10/1990 | |
| FR | 2 465 603 | 3/1981 | B60F/3/00 |
| GB | 1 416 986 | 12/1975 | B63B/7/00 |
| GB | 1 587 183 | 4/1981 | B60F/3/00 |
| GB | 2 355 695 A | 5/2001 | B63B/7/04 |
| GB | 2 364 673 A | 2/2002 | B63B/7/04 |

* cited by examiner

*Primary Examiner*—Sherman Basinger
(74) *Attorney, Agent, or Firm*—Davis & Bujold, PLLC

(57) ABSTRACT

Bow and stern sections (1,2) of a boat are hinged together to enable the bow section (1) to be folded over the stern section (2) which has wheels (6) deployed for towing and storage on land. The folded boat is towed by a towbar (10) bolted to a retracted spine (8) of a chassis (7) on which the stern section (2) is mounted. The spine (8) is extendable telescopically to support the unfolded bow section (1), and the wheels (6) are pivotally-mounted on the chassis (7) to be retracted by over-center operation, into open-bottom compartments (26) of the stern section (2); an interlock with the spine (8) precludes wheel-retraction while the spine (8) is retracted. Spring-biased doors (36) are freed to close the open-bottoms of the compartments (26) in response to retraction of the wheels (6). The hinging of the bow and stern sections (1,2) is via a panel (5) which is pivoted to both sections (1,2) and which closes a gap between bulkheads (3,4) in the folded boat and provides a seat over them when the bow section (1) is unfolded.

30 Claims, 9 Drawing Sheets

FOLDABLE BOATS

FIELD OF THE INVENTION

This invention relates to boats.

SUMMARY OF THE INVENTION

According to one aspect of the present invention there is provided a boat wherein two sections of its length are hinged together to enable a first of the sections to be folded over the second section for reducing overall length, and the second section is supported longitudinally on an elongate spine that is selectively extendable lengthwise to afford longitudinal support for the first section when unfolded from the second section for use of the boat on water.

The foldability of the boat to reduce overall length is of especial advantage for towing and storage purposes on land, and the use of the extendable spine for longitudinal support of the first section when unfolded, as well as of the second section, gives a longitudinal strength to the boat unifying the two sections, without the need to rely for such strength on interconnection between them. Moreover the spine, which may be telescopically-extendable, provides a means for attachment and handling of the boat for towing and maneuvering the boat whether folded on land or unfolded on land or water.

The two sections may be bow and stern sections, and may be of substantially the same length as one another to provide the maximum saving of overall length. More especially in this case, the bow section may fold over the stern section, and the spine when extended may provide support for the bow section along substantially the full length of the unfolded bow section. Furthermore, the stern section may be mounted on a chassis that includes the extendable spine, and the chassis may have wheels, for example a pair of laterally-spaced wheels, for transporting the boat on land. The wheels may be retractable.

According to another aspect of the present invention there is provided a boat having wheels that are deployed for transporting the boat on land, the wheels being selectively retractable from the deployed condition into one or more recesses of the hull of the boat, for use of the boat on water.

When retracted, the wheels preferably lie within the compass of the hull such that they do not project from, or do not project to any substantial extent from, the generally streamline contour defined by the hull. In this regard, more particularly, the wheels may be selectively retractable into respective compartments that open through the bottom of the hull of the boat, and the openings through the hull to the compartments may be closed by respective doors in response to retraction of the wheels.

The boat with selectively-retractable wheels may have, as referred to above, bow and stern sections that are hinged together to enable the bow section to be folded over the stern section, and an extendable spine for supporting the two sections. In these circumstances, the wheels may be mounted on a chassis that includes the extendable spine, and an interlock may be provided to preclude the retraction of the wheels until the spine is extended.

BRIEF DESCRIPTION OF THE DRAWINGS

A foldable boat with retractable wheels, according to the present invention will now be described, by way of example, with reference to the accompanying drawings, in which.

DETAILED DESCRIPTION OF THE INVENTION

Figure 1:
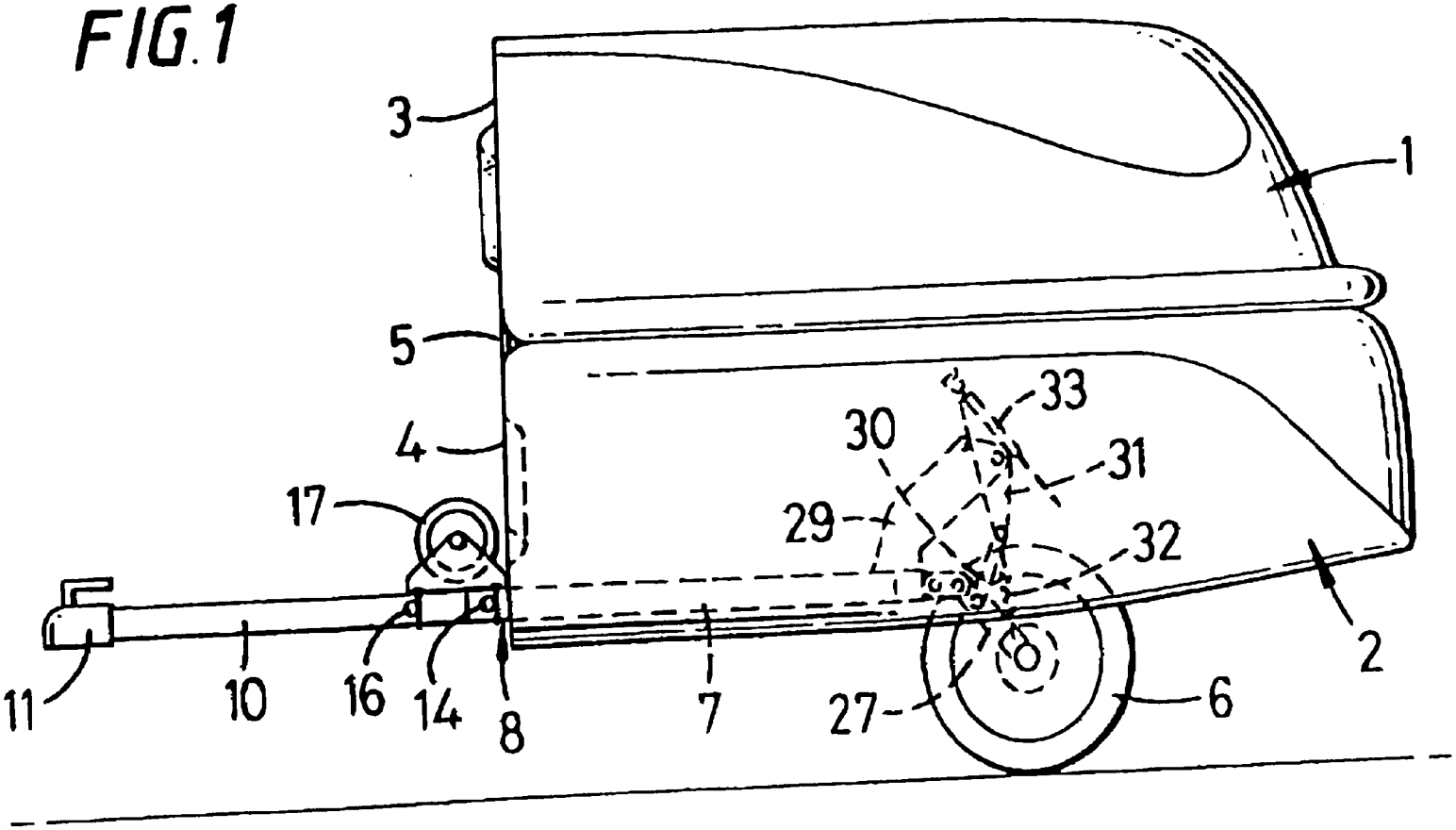
FIG. 1 is a side elevation of the boat according to the present invention, folded in half and with its wheels deployed ready for towing.
Figure 2:
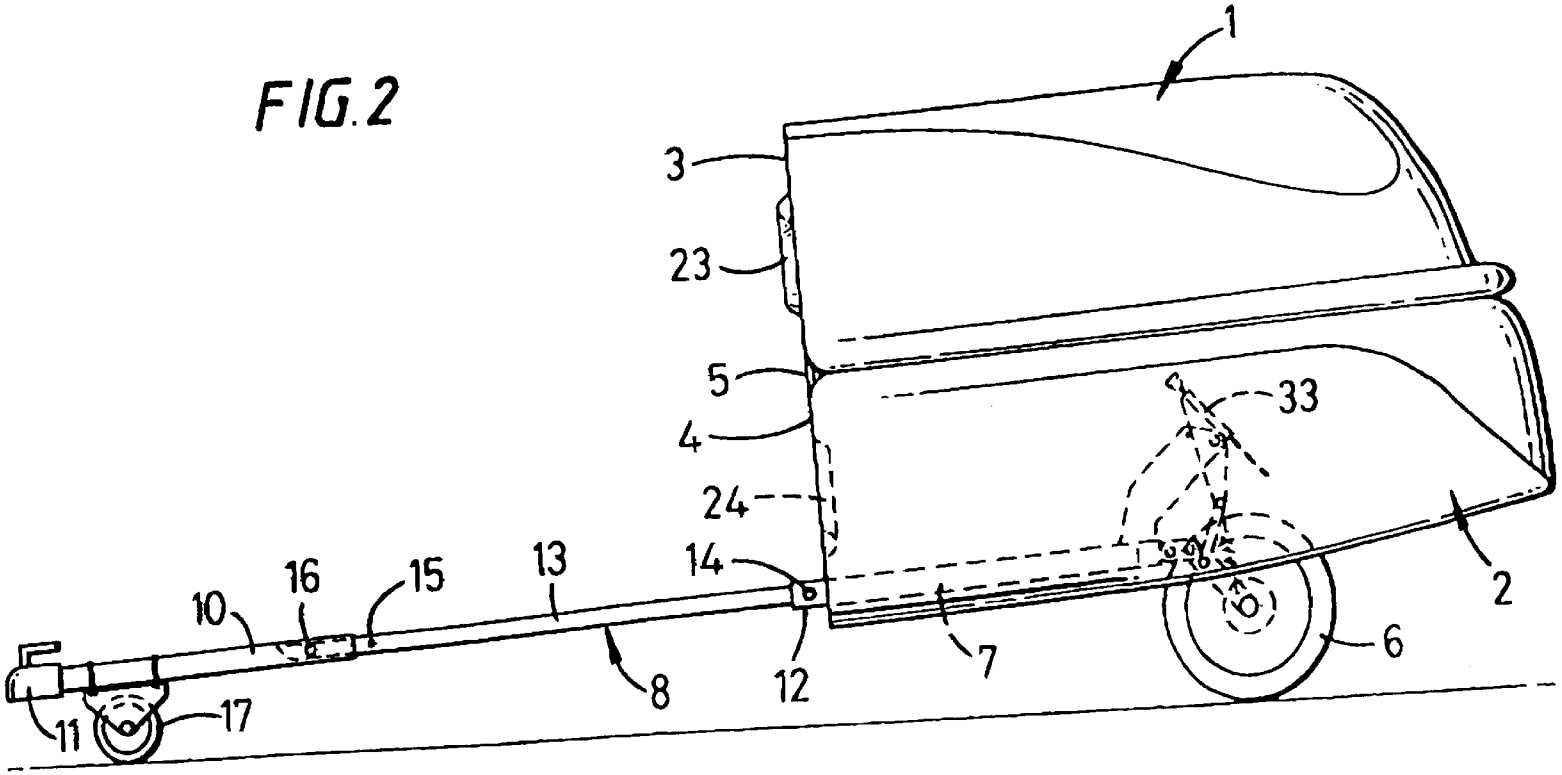
FIGS. 2 and 3 are, respectively, a side elevation and a perspective view from the front, of the folded boat of FIG. 1 in a preparatory state for unfolding.
Figure 3:
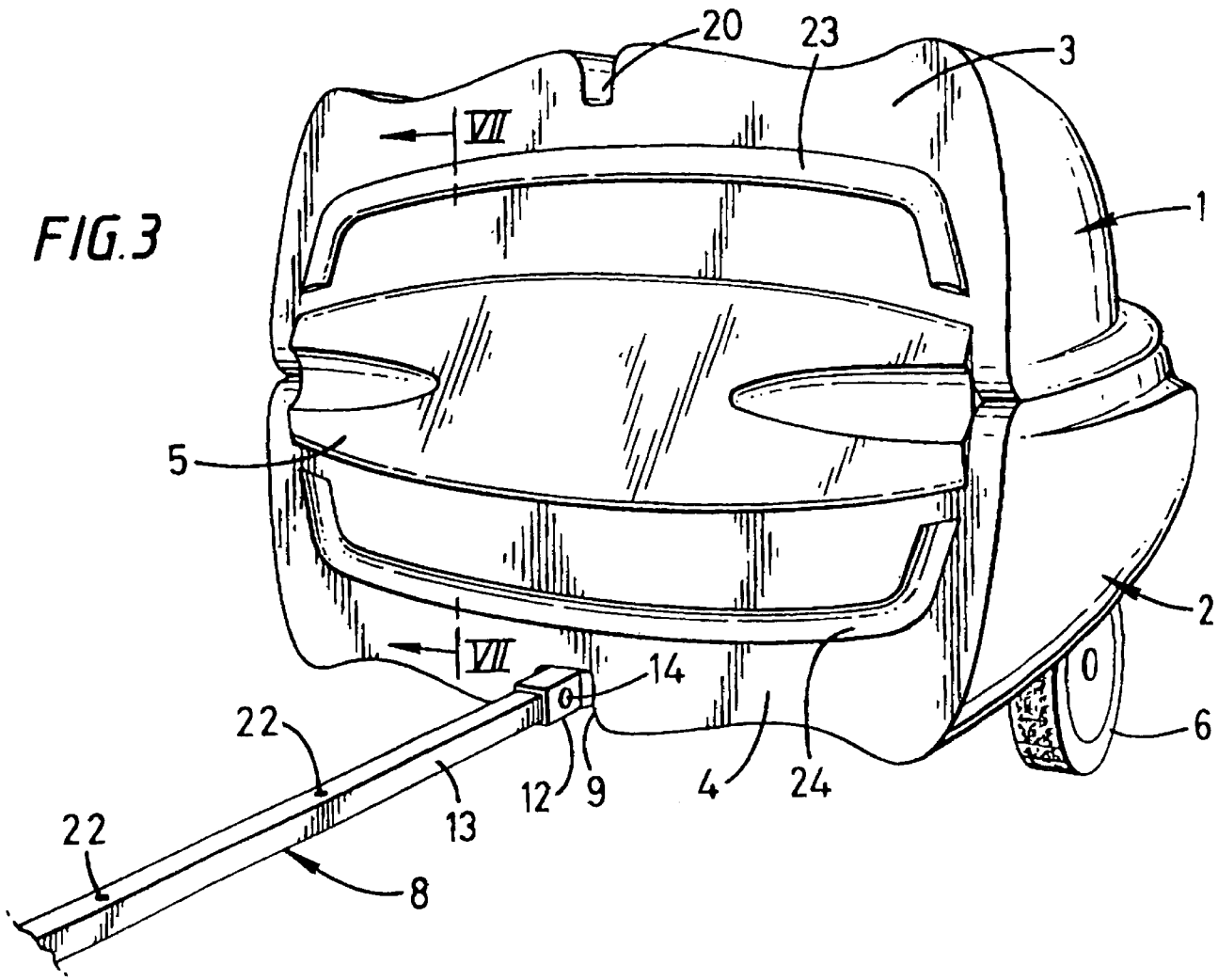
Figure 4:
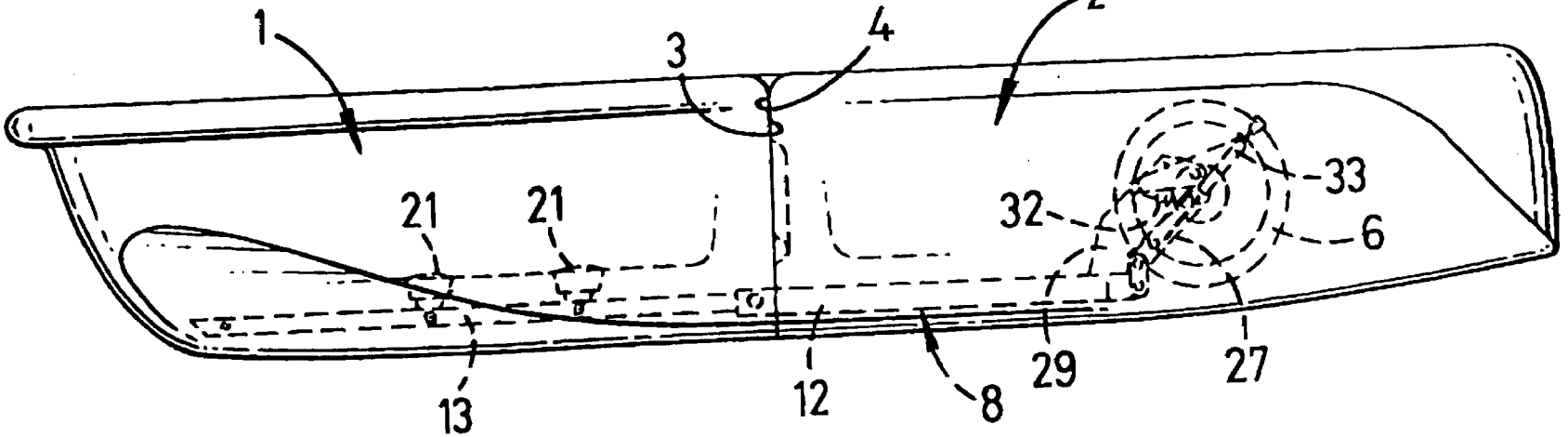
FIG. 4 is a side elevation of the boat of FIG. 1 when unfolded and in use afloat with its wheels retracted from their deployed condition.
Figure 5:
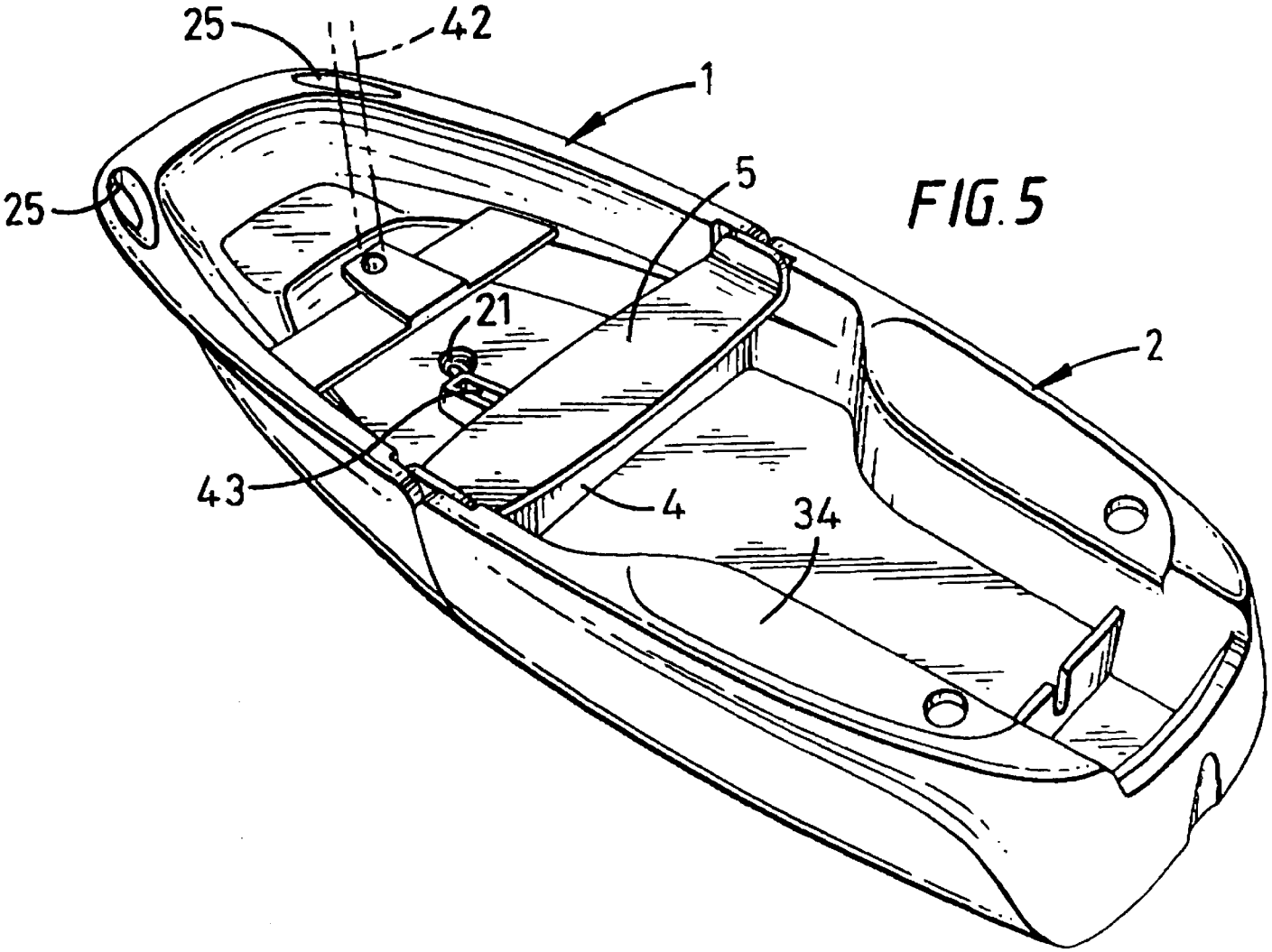
FIG. 5 is a perspective view from above of the boat of FIG. 1, unfolded.
Figure 6:
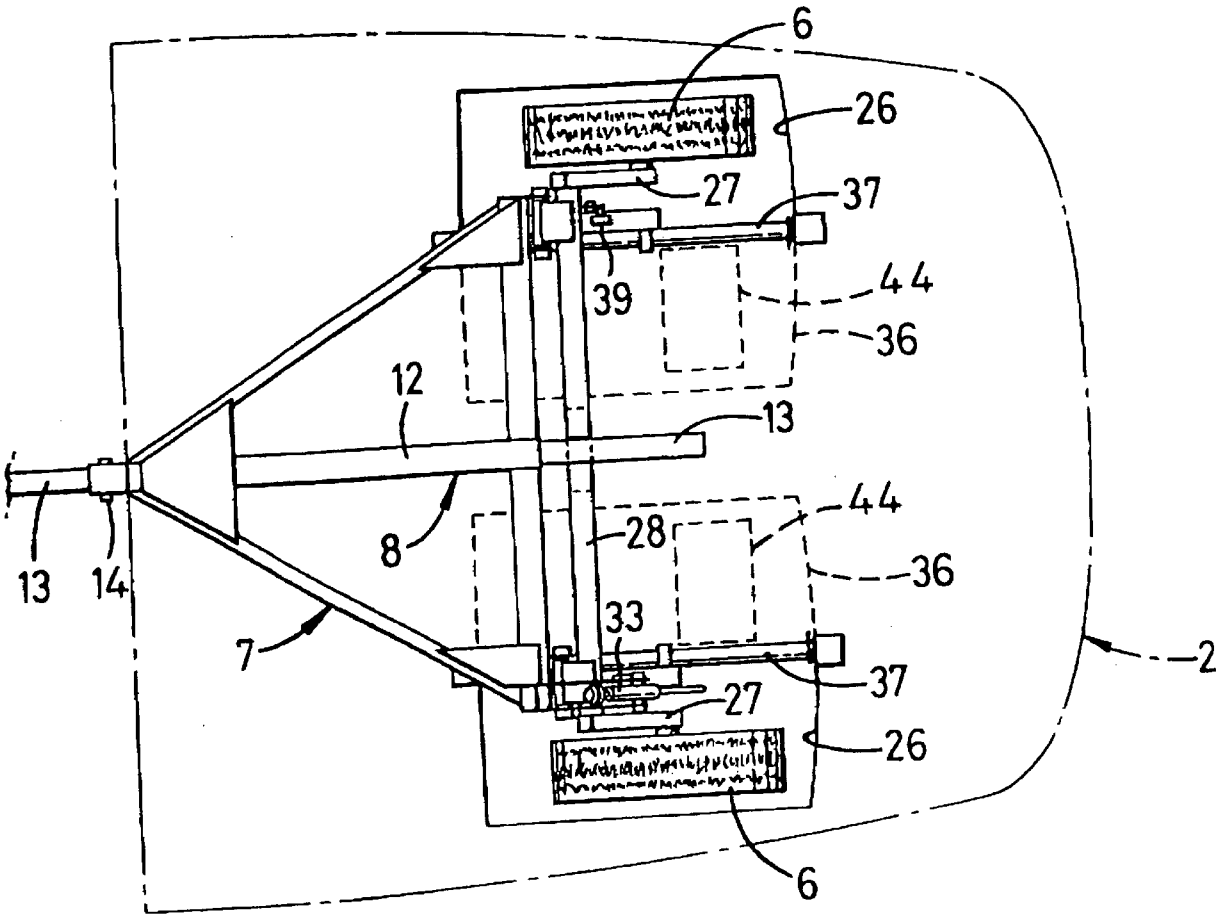
FIG. 6 is a plan view of a chassis of the boat of FIG. 1.

Referring to FIGS. 1 to 5, the hull of the boat is divided into respective water-tight bow and stern sections 1 and 2 of substantially equal length, by respective bulkheads 3 and 4. The bulkheads 3 and 4 are hinged together allowing the bow section 1 to be folded over the s: tern section 2 as shown in FIGS. 1 to 3, to reduce the length of the boat for towing and storage. The hinging is effected through a panel 5 which, as illustrated in FIG. 3, closes a gap between the bulkheads 3 and 4 in the folded boat and which in the boat unfolded as illustrated in FIG. 5, provides a central seat. Referring now also to FIG. 6, a pair of tired wheels 6 are mounted laterally spaced from one another on an A-frame chassis 7 to which the stern section 2 is bolted. The chassis 7 includes a central, telescopic spine 8 of the boat that extends within a longitudinal central-well or-channel 9 (FIG. 3) in the underside of the stern section 2 to project forwardly from the bulkhead 4. The projecting end of the spine 8 is terminated, in the folded condition of the boat, by a tubular towbar 10 that has a conventional coupling-head 11 for engaging the tow-ball (not shown) of a towing vehicle.

When the boat is to be used, it is unfolded from the condition illustrated in FIGS. 1 to 3, after first extending the spine 8, and releasing from the rear a tailboard (not shown) that not only gives conformity to road-traffic regulations but also secures the bow and stern together. The telescopic spine 8, which is formed by an outer tube 12 and an elongate, inner bar 13, has a retracted condition as illustrated in FIGS. 1 and 6, in which the bar 13 projects slightly from the tube 12 just forwardly of the bulkhead 4, and is extended by drawing the bar 13 forwardly out from within the tube 12 as illustrated in FIGS. 2 and 3. A bolt 14 that is held in a hole (not shown) through the forward end of the tube 12 is used to secure the spine 8 in both the retracted and extended conditions, the bolt 14 extending through an aligned hole 15 (revealed in FIG. 2) of the bar 13 for the retracted condition, and through a corresponding hole (not shown) for the extended condition. A further bolt 16 is used to secure the tubular towbar 10 to the forward end of the bar 13.

As illustrated in FIG. 1, a jockey-wheel 17 is stowed during towing close upon the bulkhead 4, being clamped to both the spine 8 and the tubular towbar 10 and bridging the divide between them. In this regard, the jockey-wheel 17 augments the function of the bolts 14 and 16 in securing the spine 8 to the towbar 10, and is removed and relocated on the towbar 10 as illustrated in FIG. 2, as a preliminary to extension of the spine 8. The jockey-wheel 17 may in itself couple the spine 8 to the towbar 10 with sufficient strength for towing, to enable the removable bolts 14 and 16 to be replaced by spring-actuated pins for engaging the bar 13 in the retracted and extended conditions. Alternatively, where adequate strength for towing is achieved with the bolts 14 and 16 or otherwise, the jockey-wheel 17 may be attached to the towbar 10 permanently.

Figure 7:
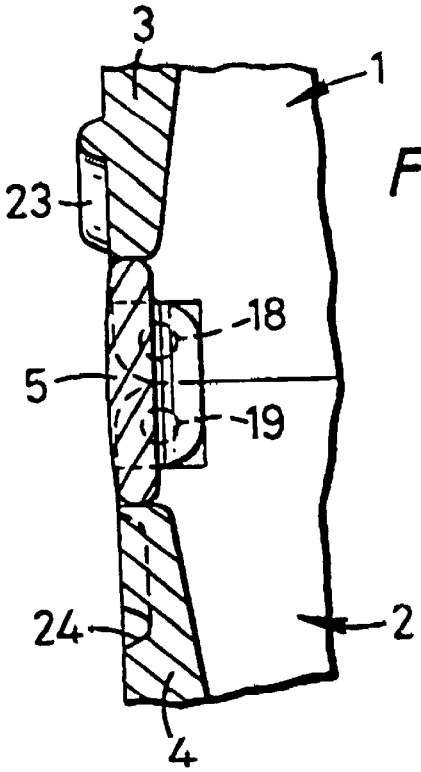
FIGS. 7 to 9 show details of the hinging of the boat during successive stages of unfolding, the section of FIG. 7 being taken on the line VII—VII of FIG. 3.
Figure 8:
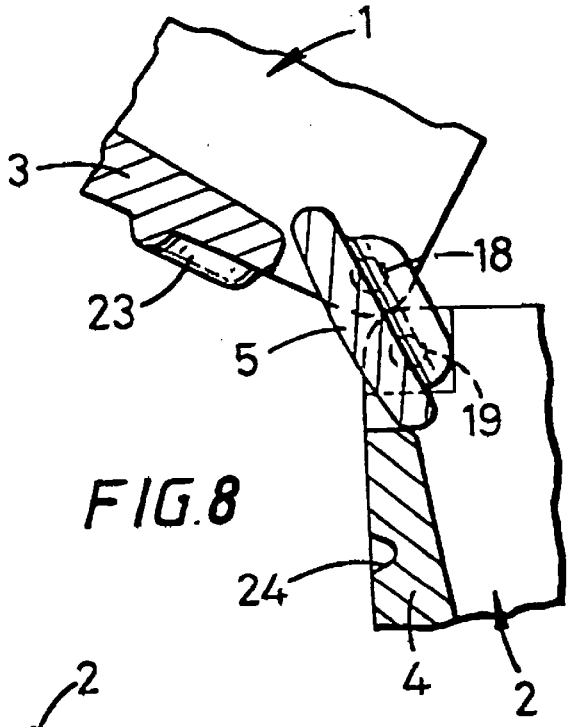
Figure 9:
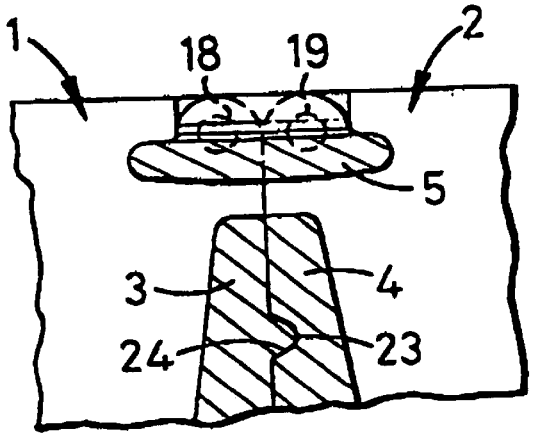

Having extended the spine 8 with the jockey-wheel 17 located on the towbar 10, the folded-over bow section 1 is lifted up from the stern section 2, and turned on the hinging of the panel 5 to bring it down towards alignment with the stern section 2. As illustrated in FIG. 7, the panel 5 is hinged by means of two pivots 18 and 19 at either end, the pair of pivots 18 hinging it to the bow section 1 and the pair of pivots 19 hinging it to the stern section 2. Accordingly, as the bow section 1 is lifted up and turned over, the panel 5 turns on both pairs of pivots 18 and 19 as illustrated in FIG. 8, until the bow section 1 is brought through 180 degrees, into alignment with the stern section 2 as illustrated in FIG. 9. The panel 5 has now turned through 90 degrees to form a transverse seat (FIG. 5) with the bulkheads 3 and 4 abutting one another back to back beneath.

A central-channel 20 (FIG. 3) corresponding to the channel 9, runs longitudinally of the underside of the bow section 1, so as to enable the section 1 to be brought down over the extended spine 8 into alignment with the stern section 2. The bow section 1 is now secured to the spine 8 using two bolts 21 that screw into holes 22 (FIG. 3) in the bar 13. The bow and stern sections 1 and 2 are in this way clamped together as one through the spine 8 with the bulkheads 3 and 4 pressed hard upon one another without the need for interconnection between them. Moreover, a projecting lip 23 of the bulkhead 3 is squeezed into a recess 24 of the bulkhead 4 to provide an effective seal between them.

The unfolded boat can be maneuvered on its wheels 6 very easily and can be pulled or pushed to, and into, the water, using the towbar 10 whether still coupled to the vehicle or held manually. The towbar 10 with the attached jockey-wheel 17, is then, or earlier, removed by withdrawing the pin 16, leaving the bow of the boat clear. Even with the towbar 10 removed, the boat can be maneuvered easily on the wheels 6 using hand-holds 25 (FIG. 5) in the bow section 1.

Once the boat is afloat, the wheels 6, are retracted through the bottom of the boat into the stern section 2. More particularly, the wheels 6 even when fully deployed, extend partially into respective open-bottom compartments 26 (FIG. 6) of the hull of the boat that are large enough to accommodate the wheels 6 fully retracted. The wheels 6 are carried by radial arms 27 which are interconnected by a shaft 28 that extends transversely of the spine 8, and are retracted into the compartments 26 by upward angular movement of the arms 27 relative to the chassis 7.

In this regard, and referring to FIGS. 1, 2 and 4, each arm 27 is pivoted to the chassis 7 and its angular disposition relative to a bracket 29 of the chassis 7 is determined by links 30 and 31 that are pivoted to one another and to the arm 27 and bracket 29 respectively. A spring 32 is active on the links 30 and 31 to provide them with a strong over-center action by which in one condition (illustrated in FIGS. 1 and 2) the arm 27 extends downwardly for deployment of its wheel 6, and in the other of which (illustrated in FIG. 4) the arm 27 extends upwardly for full retraction. Operation of the over-center mechanism is effected manually by means of an extendable lever-arm 33 that is coupled to the link 31 within one of the compartments 26 and is accessible from within the boat through a cover 34 (FIG. 5) to that compartment 26. Pulling the arm 33 to pivot rearwardly brings about retraction of both wheels 6 together, whereas pulling in the opposite direction deploys them.

An interlock is active between the spine 8 and the shaft 28 to preclude retraction of the wheels 6 from the deployed condition until the spine 8 has been extended. The action of the interlock is illustrated in FIGS. 10 and 11 and will now be described.

Figure 10:
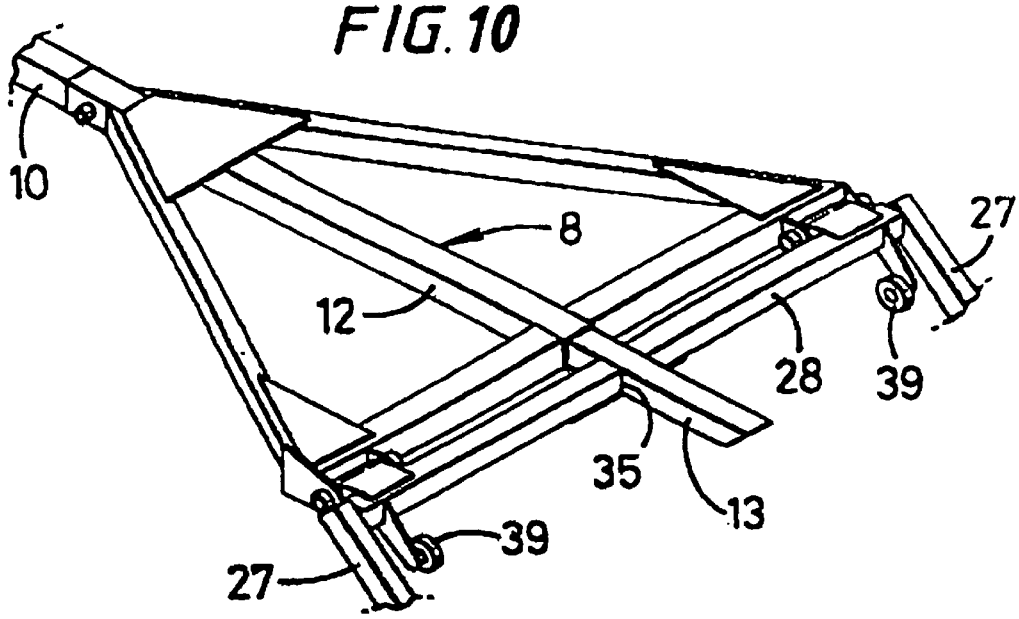
FIGS. 10 and 11 are perspective views illustrative of features of the chassis of the boat.
Figure 11:
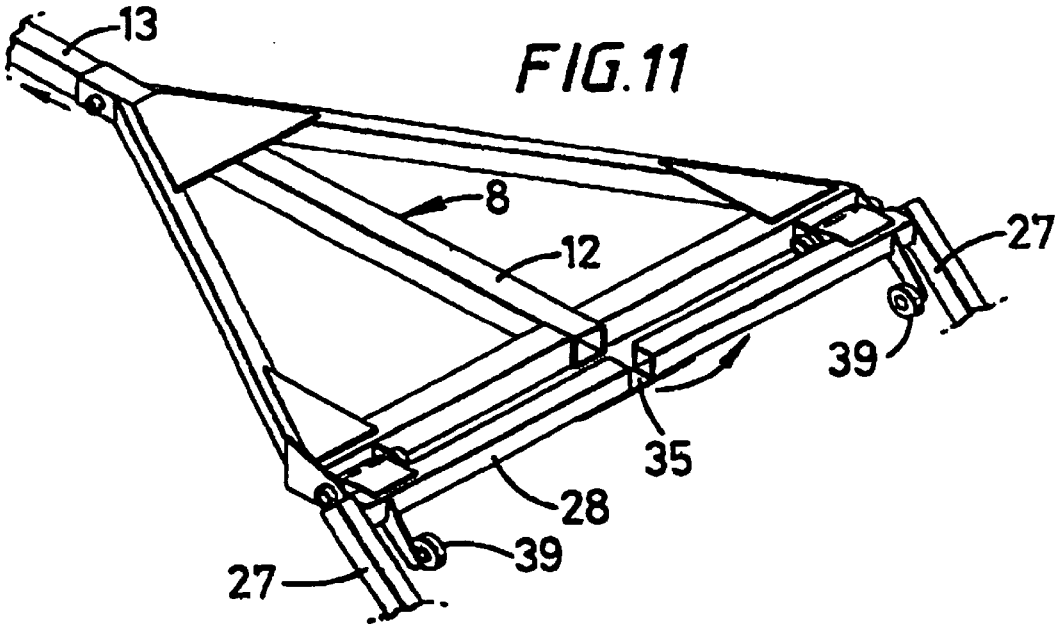

Referring to FIG. 10, the bar 13 of the spine 8 projects rearwardly from the tube 12 while the spine 13 is retracted, and in this condition extends through a gap 35 in the shaft 28. This blocks positively any upward angular displacement of the shaft 28, and therefore of the arms 27 carrying the wheels 6, from the deployed condition. It is only when the bar 13 has been pulled forwardly through the tube 12 to extend the spine 8 and vacate the gap 35 as illustrated in FIG. 11, that the shaft 28 and with it the arms 27, can turn upwardly to retract the wheels 6 into the compartments 26.

Figure 12:
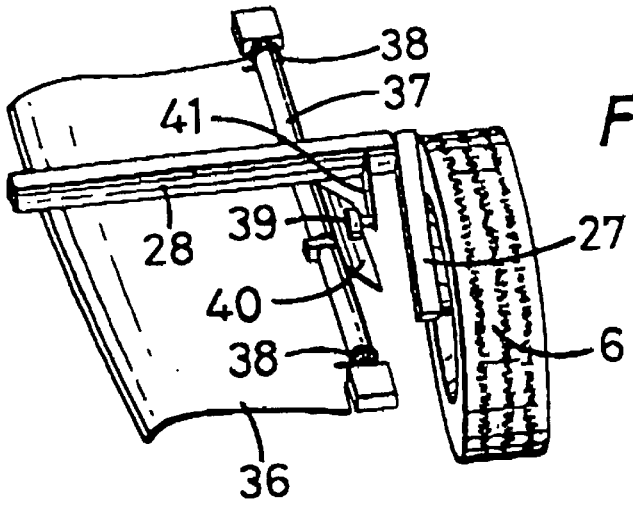
FIGS. 12 to 14 are illustrative of successive stages during retraction of the wheels of the boat from their deployed condition.
Figure 13:
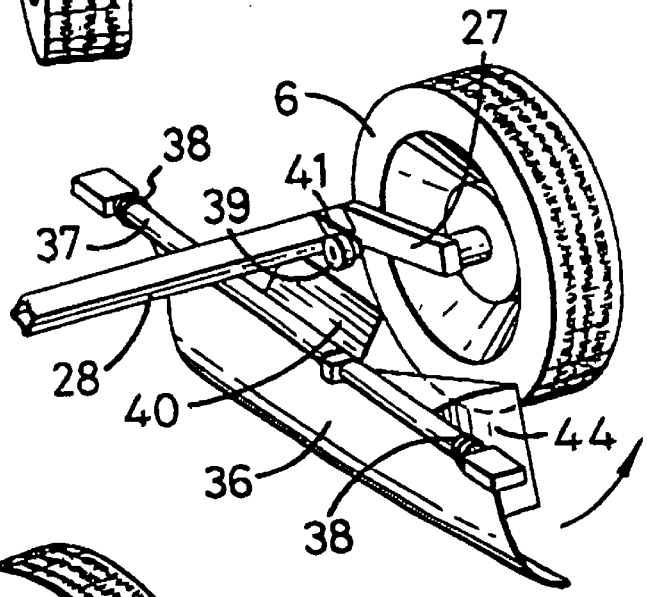
Figure 14:
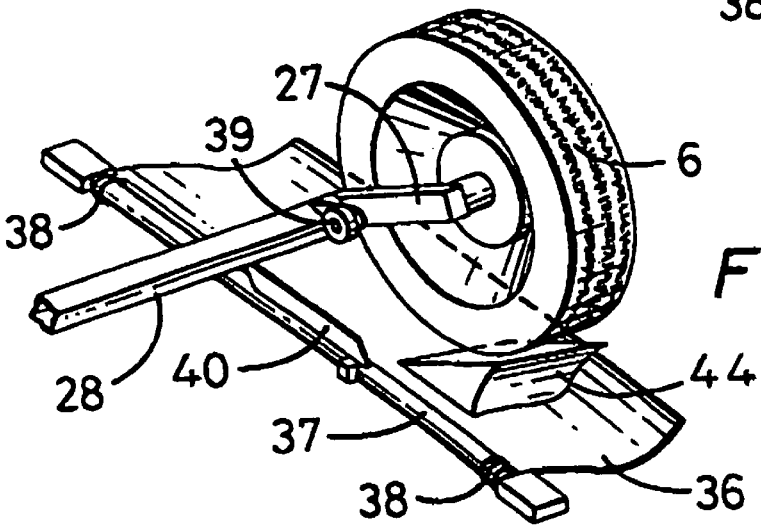

Retraction of the wheels 6 is accompanied by closing of the bottom-openings of the compartments 26 by doors 36 to give the hull of the boat a substantially uninterrupted streamline configuration. The doors 36 are hinged to respective arms 37 (FIG. 6) that project rearwardly from,the chassis 7 alongside the wheels 6, and as illustrated more especially in FIGS. 12 to 14, each is urged by springs 38 to swing downwardly to close onto the adjacent wheel 6. While the wheel 6 is deployed, however, and as illustrated in FIG. 12, a small runner-wheel 39 abuts an angled extension-flap 40 of the door 36 to restrain it from turning from a swung-back, fully-open condition. The runner-wheel 39 is coupled via an arm 41 to the shaft 28 so that it is not until the shaft 28 has turned sufficiently as illustrated in FIG. 13 during retraction of the wheel 6, that the runner-wheel 39 clears the flap 40. Once the runner-wheel 39 has cleared the flap 40, the door 36 is free to turn under the action of the springs 38. The wheel 6 is at this time wholly within its compartment 26 so that the door 36 continues to turn until it closes the bottom-opening of the compartment 26 beneath the wheel 6, to the condition illustrated in FIG. 14. The springs 38 hold the door 36 firmly closed.

The boat may be powered by sail or outboard motor. For sail, the fore-most bolt 21 holding the bow section 1 to the spine 8 may be replaced by a screw-cup fixing for the support of a mast such as indicated by broken line 42 in FIG. 5 A slot 43, slightly off-center in order to avoid the spine 8, is provided for a centerboard or daggerboard.

When the boat is to be brought onto land, the wheels 6 are deployed from the retracted condition while the boat is still afloat in water deep enough to give significant clearance of the water-bottom. The wheels 6 are deployed by opening the cover 34 and pulling the extended lever-arm 33 forwardly. This acts through the link 31 to operate the over-center mechanism formed with the link 30 to turn the arms 27 carrying the wheels 6, downwardly. As each wheel 6 moves downwardly within its compartment 26, it pushes down on a ramp 44 of the door 36 beneath it (FIG. 14), to open and progressively turn the door 36 back. The turning back of the door 36 accompanies continued turning of the shaft 28 and, with it, downward movement of the wheel 6, to bring the runner-wheel 39 onto the flap 40 again. Further downward movement of the wheel 6 to complete deployment restores the condition illustrated in FIG. 12 in which the door 36 is held in the swung-back, fully-open condition.

Once the wheels 6 have been deployed, the boat can be readily propelled under sail, motor or otherwise, until the wheels 6 ground. The boat can then be drawn or pushed from the water on the wheels 6 using, for example, the hand-holds 25 or the re-attached towbar 10. Having established the boat supported by the wheels 6, it can be folded again ready for towing, and to this end, it is simply necessary to release the bolts 21 and lift the bow section 1 up to hinge back over the stern section 2. As this is done, the panel 5 turns on its pivots 18 and 19 to close the space between the bulkheads 3 and 4 in the folded boat. The spine 8 can now be retracted by pushing the bar 13 rearwardly into the tube 12 and securing it with the bolt 14. The pushing back of the bar 13 re-establishes the interlock in which the bar 13 extends through the gap 35 in the shaft 28 to block retraction of the wheels 6.

For towing, the towbar 10 is re-attached to the bar 13 using the bolt 16 (if this has not already been done), the jockey-wheel 17 is stowed close upon the bulkhead 4, and the tailboard is secured to the rear.

What is claimed is:

1. A foldable boat wherein first and second sections forming a length of the boat are hinged together to enable the first section to be folded over the second section for reducing an overall length of the boat, the boat including an elongate spine for longitudinal support of the second section, the spine being selectively extendable lengthwise to provide a longitudinal support for the first section when the first section is unfolded from the second section for use of the boat on water, and the first and second sections are, respectively, a bow section and a stern section of the boat, the spine when extended for support of the bow section provides support for the bow section along substantially the full length of the unfolded bow section, the boat including a chassis, and the spine is incorporated in the chassis, the stern section is mounted on the chassis, and wheels for transporting the boat on land are mounted on the chassis, the wheels are selectively retractable into recesses of the hull of the boat and the boat includes interlock mechanisms, the interlock mechanisms being operative to preclude retraction of the wheels until the spine is extended as aforesaid.

2. A boat having wheels that are deployed for transporting the boat on land, the wheels being selectively retractable from a deployed condition into at least one recess of a hull of the boat for use of the boat on water, wherein the boat comprises bow section and a stern section that are hinged together to enable a-first of the bow and stern sections to be folded over a second of the bow and stern sections for reducing an overall length of the boat, the second section is supported longitudinally on an elongate spine that is selectively extendable lengthwise to provide a longitudinal support for the first section when unfolded from the second section, and an interlock is active to preclude retraction of the wheels until the spine is extended as aforesaid.

3. A foldable boat wherein first and second sections of a length of the boat are hinged together to enable the first section to be folded over the second section for reducing an overall length of the boat, the boat includes a chassis having wheels for transporting the boat on land, the second section of the boat is mounted on the chassis centrally with respect to the wheels, and the chassis includes an elongate, central spine for longitudinal, central support of the second section, and the spine is selectively extendable lengthwise for providing a longitudinal, central support for the first section when the first section is unfolded from the second section for use of the boat on water, the first section unfolding onto the extended spine, and a clamping mechanism is operable to clamp the first section to the extended spine for holding the first and second sections together in mutual longitudinal alignment via the extended spine during use of the boat on water.

4. The boat according to claim 3, wherein the clamping mechanism comprises at least one bolt that screws into the extended spine to clamp the first section thereto.

5. The boat according to claim 3, wherein the two sections are of substantially the same length as one another.

6. The boat according to claim 3, wherein the spine is telescopically-extendable.

7. The boat according to claim 3, wherein the first and second sections respectively, bow and stern sections of the boat.

8. The boat according to claim 7, wherein the spine when extended for support of the bow section provides support for the bow section along substantially the full length of the unfolded bow section.

9. The boat according to claim 7, wherein the stern section includes a plurality of compartments having respective openings through the bottom of the stern section, and the boat includes selectively-operable mechanisms for retracting the wheels into respective ones of the compartments through the openings.

10. The boat according to claim 9, including doors for closing the openings, and mechanism operable to close the doors in response to retraction of the wheels.

11. The boat according to claim 3, wherein the wheels are a pair of wheels mounted on the chassis and spaced apart from one another laterally of the spine.

12. The boat according to claim 11, wherein the mounting of the wheels includes an over-center mechanism that is operable to retract or deploy the wheels selectively.

13. The boat according to claim 3, wherein the wheels are selectively retractable into recesses of the hull of the boat.

14. The boat according to claim 13, wherein the mounting of the wheels on the chassis includes an over-center mechanism, the over-center mechanism being operable to selectively retract or deploy the wheels.

15. The boat according to claim 13, wherein an interlock is active to preclude retraction of the wheels until the spine is extended as aforesaid.

16. The boat according to claim 3, including towbar coupling means for coupling to the spine for towing the boat when the first section is folded over the second section.

17. The boat according to claim 3, wherein the first and second sections include two bulkheads respectively, the two bulkheads abutting one another back to back in the unfolded condition of the boat, the boat further including an elongate panel member that extends across the first and second sections to bridge both bulkheads when the boat is in its unfolded condition, and first and second pivots at each end of the panel to pivot the first and second sections to the panel independently of one another for turning about the panel in moving between the folded and unfolded conditions of the boat, the first of the two pivots being between the panel and the first section and the second of the two pivots being between the panel and the second section.

18. The boat according to claim 17, wherein the panel member rotates about 90 degrees during unfolding of the boat from the folded condition.

19. The boat according to claim 17, wherein the panel member closes a gap between the bulkheads in the folded condition of the boat.

20. The boat according to claim 17, wherein the panel member forms a transverse seat with the bulkheads in the unfolded condition of the boat.

21. A boat having folded and unfolded conditions, the boat comprising an elongate bow section having an aft bulkhead, an elongate stern section having a forward bulkhead for abutting the aft bulkhead in the unfolded condition of the boat, and a hinge mechanism for hinging the bow and stern sections together to enable the boat to be brought into the folded condition in which one of the sections is folded over the other section for reducing overall length of the boat, the hinge mechanism comprising an elongate panel member that extends across the bow and stern sections to bridge both the aft and the forward bulkheads when the boat is in its unfolded condition, and first and second pivots at each end of the panel to pivot the bow and stem sections to the panel independently of one another for turning about the panel in moving between the folded and unfolded conditions of the boat, the first of the two pivots being between the panel and the bow section and the second of the two pivots being between the panel and the stern section.

22. The boat according to claim 21, wherein the panel member rotates about 90 degrees during unfolding of the boat from the folded condition.

23. The boat according to claim 21, wherein the panel member closes a gap between the bulkheads in the folded condition of the boat.

24. The boat according to claim 21, wherein the panel member forms a transverse seat over the bulkheads in the unfolded condition of the boat.

25. The boat according to claim 21, including a chassis having wheels for transporting the boat on land, the stern section of the boat is mounted on the chassis, and the chassis includes an elongate spine for longitudinal support of the stern section, and the spine is selectively extendable lengthwise for providing a longitudinal support for the bow section when the bow section is unfolded from the stern section for use of the boat on water.

26. The boat according to claim 25, wherein the wheels are a pair of wheels that are spaced apart from one another laterally of the boat.

27. The boat according to claim 26, wherein the wheels are selectively retractable into respective compartments that open through the bottom of the hull of the boat.

28. The boat according to claim 27, wherein the openings through the hull to the compartments are closed by respective doors in response to retraction of the wheels.

29. The boat according to claim 25, wherein the spine is telescopically-extendable.

30. The boat according to claim 21, wherein the bow and stern sections are of substantially the same length as one another.

* * * * *